US005186651A

United States Patent [19]

Fuchs et al.

[11] Patent Number: 5,186,651

[45] Date of Patent: Feb. 16, 1993

[54] PLUG CONNECTOR, ESPECIALLY FOR THE RELEASABLE CONNECTION OF ELECTRICAL CONDUCTORS

[75] Inventors: Helmut Fuchs; Ute Wilmsmann, both of Halver; Lothar Fuhrmeister, Schalksmuhle, all of Fed. Rep. of Germany

[73] Assignee: Firma Karl Lumberg GmbH & Co., Schalkmuhle, Fed. Rep. of Germany

[21] Appl. No.: 827,798

[22] Filed: Jan. 29, 1992

[30] Foreign Application Priority Data

Jan. 29, 1991 [DE] Fed. Rep. of Germany ..... 4102541

[51] Int. Cl.[5] ..... H01R 13/00

[52] U.S. Cl. ..... 439/495; 439/326

[58] Field of Search ..... 439/326, 492–499

[56] References Cited

U.S. PATENT DOCUMENTS

| | | | |
|---|---|---|---|
| 3,278,887 | 10/1966 | Travis . | |
| 3,366,919 | 1/1968 | Gammel, Sr. et al. | 439/326 |
| 4,886,942 | 12/1989 | Lenz et al. | 439/493 |
| 5,009,611 | 4/1991 | Regnier | 439/326 |

*Primary Examiner*—Joseph H. McGlynn

[57] ABSTRACT

A plug member for a connector of the type in which the plug member is inserted into a coupler at an angle and then swung into its end position, has a sleeve portion guiding the cable as it is inserted so that the conductors of the cable pass into channels of a portion of the plug formed with windows through which the conductors are exposed and can be engaged by contacts of the coupler passing into these windows.

17 Claims, 3 Drawing Sheets

FIG.4b
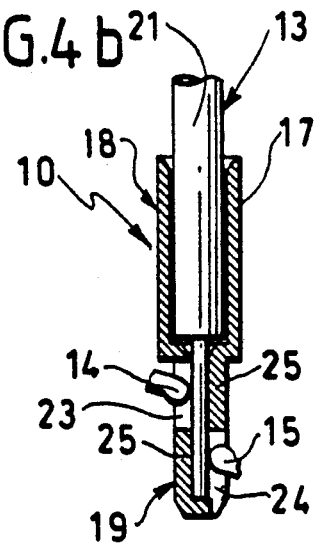
FIG.4a
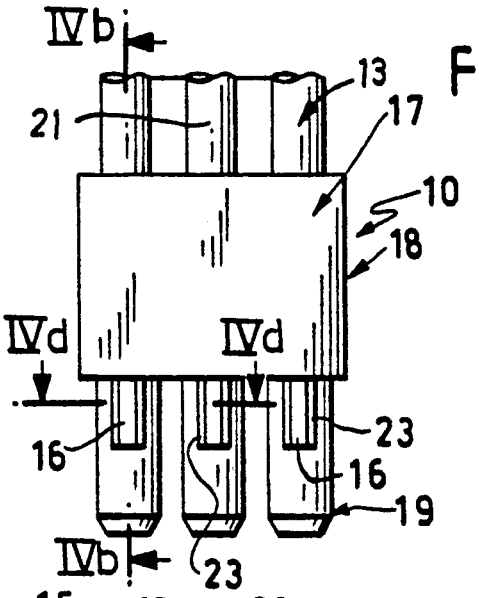
FIG.4c
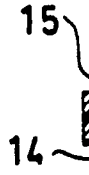
FIG.4d
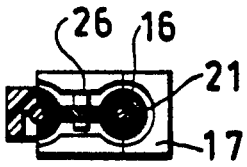
FIG.5b
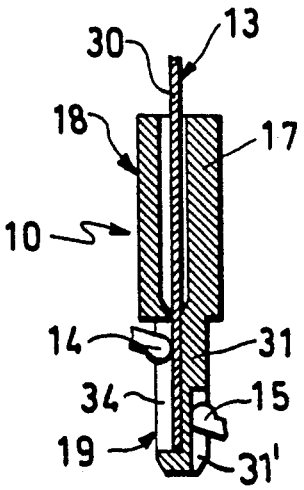
FIG.5a
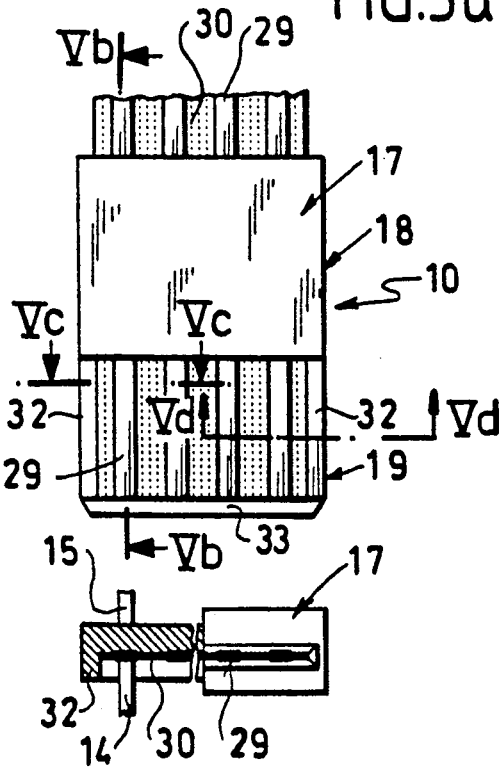
FIG.5c FIG.5d

PLUG CONNECTOR, ESPECIALLY FOR THE RELEASABLE CONNECTION OF ELECTRICAL CONDUCTORS

FIELD OF THE INVENTION

Our present invention relates to a plug connector, especially for the releasable connection of electrical conductors and, more particularly, to a plug connector of the type which comprises a plug and a coupler into which the plug is inserted in a substantially force-free manner and in which the plug can be swung into an end position to bring contacts of the coupler into engagement with conductive portions of the plug.

BACKGROUND OF THE INVENTION

A conventional plug connector of the aforedescribed type is produced by the British firm Molex and is generally provided in the form of a so-called knife blade connector. The insulating housing of the plug is of a two-part construction. In one part, a plurality of metal contacts is embedded, corresponding in number to the number of conductors of the cable to be connected and the second insulating part is locked onto the first to press the conductors into engagement with the metal contact elements of the first part.

The coupler of the connector has fork-shaped contact elements which can be connected by solder junction or lugs to a circuit-board. To effect connection between the plug and coupler, the plug is inserted in an inclined orientation to a receptacle in the coupler until the metal contact elements of the plug are juxtaposed with countercontacts of the coupler. The plug is then swung through an angle of about 25° into a defined end position in which it can be locked. In this position the connector is mechanically and electrically fixed and the contacts of the plug firmly engage the contacts of the coupler by an opposite sequence of operations, the plug can be removed from the coupler, i.e. the plug can be swung back to its first position and then withdrawn in a force-free manner.

Because the original insertion and removal of the plug portion of the connector can be effected in a more or less force-free manner, the plug connector has many advantages over other connection systems and similar plug connectors have been fabricated by other manufacturers. Nevertheless, in all of these systems, the construction of the plug portion or member of the connector is somewhat more complex than is necessary.

OBJECTS OF THE INVENTION

It is, therefore, the principal object of the present invention to provide a connector which operates like the Molex connector described, especially for flat-ribbon cables, whereby disadvantages of these earlier systems are avoided.

Another object of the invention is to provide an improved plug connector of the aforedescribed type with a simpler construction of the plug member.

SUMMARY OF THE INVENTION

These objects are attained, in accordance with the present invention, by forming the first connector member, i.e. the plug member, in the region thereof accommodating the conductor or conductors of the cable with at least one window, i.e. so that it is partially open, and each of the contacts of the second connector member, i.e. the coupler, can directly engage the conductor through the respective window.

By contrast with the earlier system, therefore, no separate metal elements are required on the plug member of the connector, so that this connector portion can be constituted exclusively of a single one-piece and unitary injection-molded body of a insulating material, especially a synthetic resin. An important aspect of the invention, therefore, is to provide the first connector part or plug member so that it is partly open and so that the contacts of the second connector part can engage stripped conductors or noninsulated conductors of the first connector part directly.

More particularly, the plug connector of the invention can comprise:

a plug formed with an insulating body adapted to receive a wire and having an elongated portion formed with at least one window through which a conductor of the wire is exposed; and a coupler having an insulated hollow body receiving the plug in a force-free first position, the plug being swingable in the body of the coupler into an end position, the coupler having a contact engageable through the window with the conductor upon swinging of the plug from the one position into the end position.

The invention thus greatly simplifies the construction of the first connector part or plug member. This part is not only greatly simplified with respect to configuration, but the mounting of this plug connector on the cable or the insertion of the cable into the plug connector is greatly simplified and less time-consuming and hence less expensive.

With the system of the invention, it is merely necessary to insert the cable into the first or plug part. The plug of the connector can be applied to the cable beforehand, i.e. prior to connecting the plug with the coupler. Alternatively we can insert the plug in the coupler in a premounting position, i.e. in the first position in which the contacts do not penetrate through the window, whereupon the cable is inserted and the plug then swung into the end position.

When the conductors are stripped or noninsulated wires of a collection of individual wires or are individual conductors of a flat-ribbon cable, it has been found to be advantageous to form the plug so that it has a sleeve-like substantially closed-wall receptacle compartment in which the insulated sheath or paths of the conductors are received while the conductors themselves pass through openings in the floor of this compartment into the elongated portion of the insulated body.

The sleeve-like compartment fixes the cable while the partly open elongated portion can be provided with the windows which form the electrical contact regions.

Since the elongated portion of the body of the plug is provided with linear channels accommodating the stripped or noninsulated conductors, and may tightly receive these conductors, it is important that the conductors not be kinked, bent or buckled. This ensures that in the contact position, an effective abutment of the contacts of the coupler with the conductors will be ensured.

Usually the contact elements of the second part of the connector, namely, the coupler, are fork-shaped so that two shanks of each contact fork will engage the conductor through respective opposite windows. It has been found to be advantageous not only to provide these windows so that they are diametrically opposite, but also to offset the windows from one another so that each window will be juxtaposed with a wall supporting the conductor against the force applied thereto by the respective contact.

In an alternative construction, windows extend parallel to one another, opposite one another and over the full length of the conductor, but have widths which are less than the diameters of the conductor. In this configuration, each conductor is braced over its entire length against the force of the contact and no longitudinal offset of the windows is required for bracing the conductors against the contact force.

The device of the invention can also be used to connect printed-circuit conductors in which the conductors are provided upon a support strip or plate in the form of printed strips. In this case, the printed conductor, composed of a foil having the discrete conductor strips printed thereon, can be inserted in the sleeve or receptacle compartment of the flat-ribbon cable in the insertion direction and the support for the side of the foil opposite that upon which the conductor is printed can be provided by a wall of the elongated portion opposite the window, or another conductor on this foil.

It has been found to be advantageous to provide strain relief for the cable directly on the sleeve portion of the plug by a clamping or form-locking element. For example, the plug can be provided with a hook which can engage in openings between conductors of a ribbon cable. The hook can be so shaped that it automatically engages in an opening of the cable as the cable is inserted into the sleeve portion.

The cable and the first part of the connector or the plug thereof can be prepackaged as a unit or the attachment of the plug portion of the connector to the cable can be effected after the plug portion has been inserted into the coupler in the first position thereof. In the latter case, the locking of the cable to the plug portion can be effected when the plug portion is angularly shifted into its end position. In either case, full strain relief may be provided by the hook, clamp or like formation.

BRIEF DESCRIPTION OF THE DRAWING

The above and other objects, features and advantages of the present invention will become more readily apparent from the following description, reference being made to the accompanying drawing in which:

FIG. 4*a* is an elevational view of the plug part of a connector preassembled on a cable according to the invention;

FIG. 4*b* is a section taken along the line IV*b*—IV*b* of FIG. 4*a;*

FIG. 4*c* is a cross section through an insert portion of the assembly shown in FIG. 4*b* illustrating the cooperation of the contacts of the coupler with the plug portion;

FIG. 4*d* is a section taken along the line IV*d*—IV*d* of FIG. 4*a;*

FIG. 5*a* is an elevational view showing another embodiment of a plug part of a connector according to the invention utilizing a printed-conductor foil;

FIG. 5*b* is a section along the line V*b*—V*b* of FIG. 5*a;*

FIG. 5*c* is a section along the line V*c*—V*c* of FIG. 5*a* illustrating the relationship of the contacts therewith; and FIG. 5*d* is a section along the line V*d*—V*d* of FIG. 5*a.*

SPECIFIC DESCRIPTION

Figure 2:
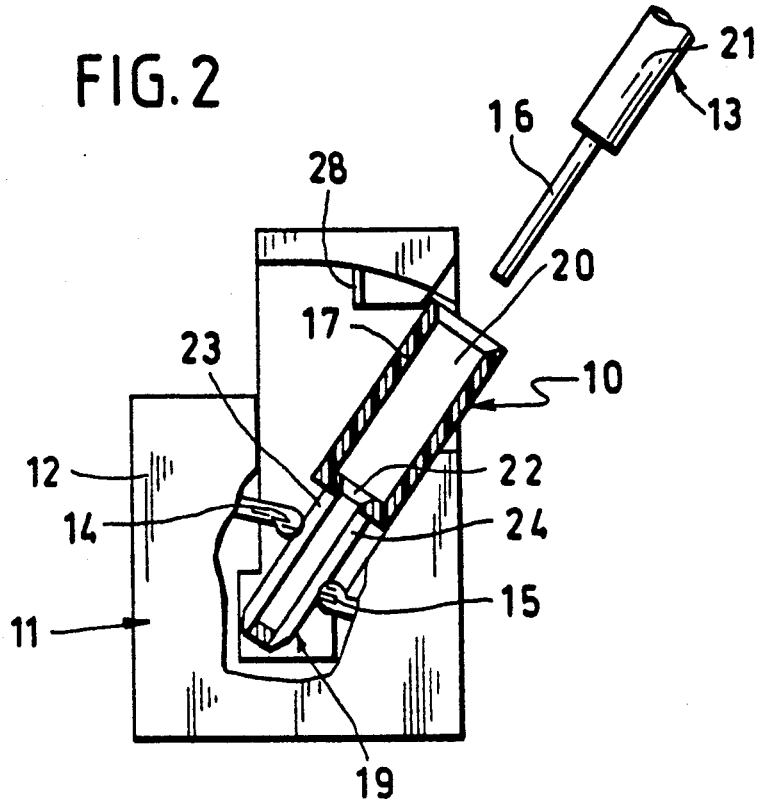
FIG. 2 is a cross sectional view of the plug connector of the invention in an initial position prior to being swung into the end position.
Figure 3:
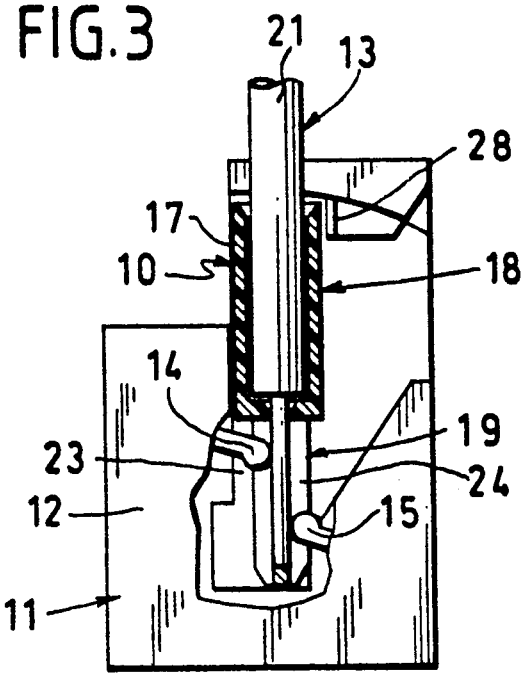
FIG. 3 is a view similar to FIG. 2 but showing the plug in its end position in the coupler.

A plug connector as shown in the drawing in FIGS. 2 and 3 can comprise a first connector part 10 forming the plug and a second connector part 11 forming the coupler.

The coupler 11 comprises an insulating body 12 formed with a number of fork-shaped contact members of which only the contact shanks 14 and 15 of one such member can be seen, these contact shanks 14 and 15 being engageable with a conductor 16 of the cable 13.

The first connector member 10 is comprised of an insulating body 17 which can be injection-molded unitarily and in one piece of synthetic resin. It is stepped to provide two portions 18 and 19. The portion 18 is a sleeve and defines a substantially sleeve-shaped closed-wall receptacle compartment 20 for the end of the ribbon cable 13 which is sheathed in insulation 21.

The elongated portion 19 is formed with channels to receive the free conductors 16 of the cable. The conductors 16 are stripped of insulation or are insulation-free.

Figure 1:
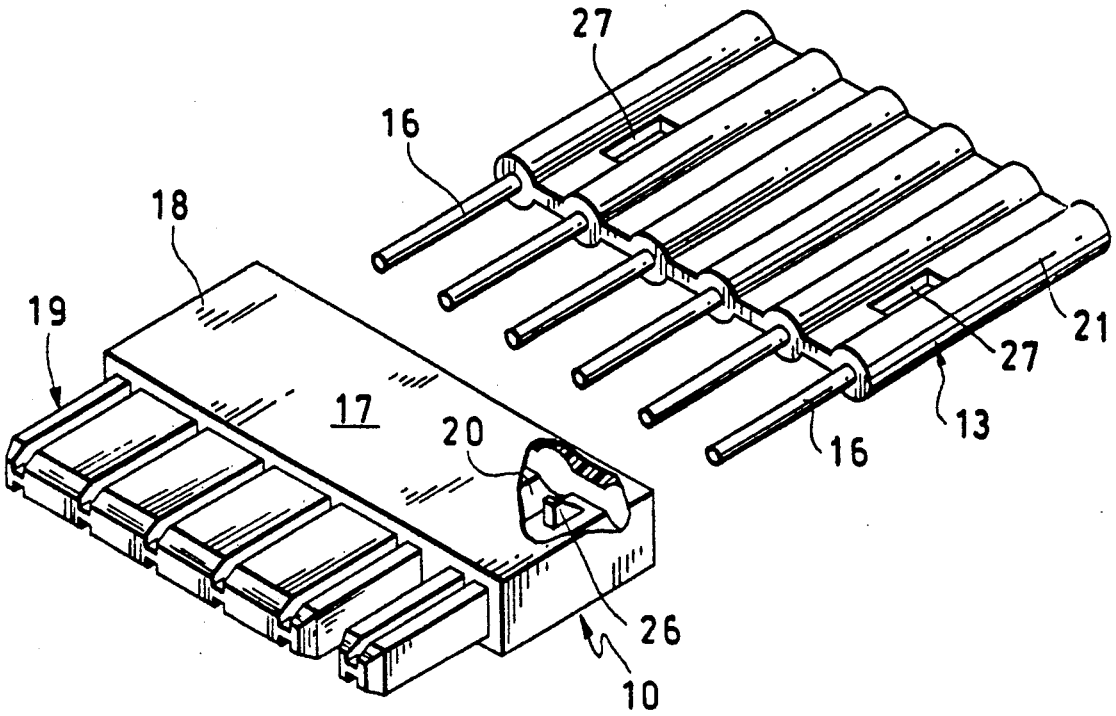
FIG. 1 is an exploded perspective view, partly broken away showing the plug part of the connector of the invention and a ribbon cable adapted to be engaged therein.

In the bottom of the compartment 20, passages 22 permit the stripped ends 16 of the cable to pass rectilinearly, i.e. without bending or buckling, into the channels of the portion 19 which can be individual tongues as shown in FIG. 1 on the right side, or a body formed with a number of channels as shown on the left side of FIG. 1. Discrete tongues 19 are shown also in FIGS. 4*a*–4*d.*

The tongue 19 is provided with a pair of diametrically opposite windows 23 and 24 through which the respective conductor 16 is exposed.

As can be seen from FIGS. 2 and 3, the windows 23 and 24 which are disposed diametrically opposite one another, extend the full length of the conductor 16, but have widths smaller than the diameter of the strip conductor so that the conductor is braced against forces which may be applied by the contact 14 and 15 when the plug 10 is swung into its end position (compare FIGS. 2 and 3).

In the embodiment of FIGS. 4*a*–4*d,* the windows 23 and 24 can be wider, although they are longitudinally offset (see especially FIG. 4*b*) so that each contact shank 14 or 15 is juxtaposed with a bracing wall 25 supporting the respective portion of the length of the stripped conductor 16 against the force of the respective contact.

Within the sleeve portion 18 of the first connector part 10, as can be seen for the embodiment of FIGS. 1 and 4*a*–4*d,* hooks 26 can be provided, which, upon insertion of the cable, can automatically engage in openings 27 in the cable between conductors thereof. The hooks in engagement with the openings 27 provide strain relief for the connector. The hooks 26 can have a sawtooth configuration as shown in FIG. 1, with a ramp automatically guiding the hook into the opening 27 to effect the form-locking connection of the cable with the plug member 10.

The plug member 10 can be prepackaged on the cable 13 so that the plug 10 with the conductor 16 inserted therein, can be introduced into the second or coupler part 11. However, the mode of operation shown in FIG. 2 can also be used.

Initially, in that case, the plug part 10 is inserted into the coupler 11 in the inclined position shown in FIG. 2. In this case, the contact shanks 14 and 15 do not project through the windows 24 or 25 sufficiently to engage the conductors 16. The cable 13 with the stripped conductor 16 is then inserted into the sleeve portion of the plug member 10 and the conductors 16 pass through the bores 22. The conductors 16 do not engage the contact shanks 14 and 15 and thus pass freely along the respective channels. Then the first part 10, with the cable 13 inserted therein, is swung in the counterclockwise sense to the end position of FIG. 3 past the detent 28 which locks the plug 10 in this end position. The portion 19 is swung into the position shown in FIG. 3 wherein each conductor 16 is engaged by the respective pair of contact shanks 14 and 15, thereby locking the plug connector mechanically and electrically.

The embodiment of FIGS. 5*a* and 5*d* differs from these other embodiments in that the conductors 29 are printed strips on a flexible foil 30 forming the cable 13 and the first connector part 10 is suitably modified to receive the foil strip 30. The sleeve portion 18 is here provided with a slot through which the foil and its conductors can pass, the foil being braced by wall 31 which can have a slot 31' to accommodate the contact 15.

The contact 14 thus presses the foil against the support wall 31. A window 34 is defined between the end wall 33 and a pair of lateral walls 32. Of course, contacts 14 and 15 can engage the strip 30 from opposite sides. The sleeve 18 serves to enable the cable 13 to be guided in place as well as a grip for the handling of the plug member of the connector.

We claim:

1. A plug connector comprising:

a plug formed with an insulating body adapted to receive a wire and having an elongated portion formed with at least one window through which a conductor of said wire is exposed; and a coupler having an insulated hollow body receiving said plug in a force-free first position, said plug being swingable in said body of said coupler into an end position, said coupler having a contact engageable through said window with said conductor upon swinging of said plug from said one position into said end position.

2. The plug connector defined in claim 1 wherein said plug is elongated in a direction perpendicular to said portion, and said wire is a flat ribbon cable.

3. The plug connector defined in claim 1 wherein said body of said plug is formed with a substantially sleeve-shaped closed-wall guide for receiving a flat ribbon cable and said elongated portion has windows through which conductors of said cable are exposed, said coupler having a plurality of contacts each engageable through a respective one of said windows upon swinging of said plug from said one position into said end position to engage the respective conductor, said portion being further formed with support wall segments backing each of said conductors and support same against pressing forces applied by said contacts to said conductors.

4. The plug connector defined in claim 1 wherein said insulating body of said plug is formed with a sleeve-shaped substantially closed-wall receptacle compartment for receiving said wire and an insulation thereon, said elongated portion being axially partly open at said window, extending from said receptacle compartment, and receiving a stripped conductor of said wire.

5. The plug connector defined in claim 4 wherein windows are provided at diametrically opposite sides of said conductor for receiving respective contacts extending through said windows from opposite directions upon swinging of said plug from said one position into said end position.

6. The plug connector defined in claim 6 wherein said windows are offset from one another along said connector.

7. The plug connector defined in claim 5 wherein said windows have widths less than a diameter of said wire.

8. The plug connector defined in claim 1 wherein said plug has a strain-relief member engageable with said wire for taking up tension on said wire.

9. The plug connector defined in claim 8 wherein said strain-relief member is at least one hook on a sleeve-shaped portion of said body of said plug receiving a cable forming said wire and formed with a opening accommodating said hook.

10. The plug connector defined in claim 9 wherein said cable is a flat ribbon cable and said opening is provided between conductors therein.

11. The plug connector defined in claim 10 wherein said hook is shaped so that said hook automatically engages in said opening in a self-locking manner upon insertion of said cable into said sleeve portion.

12. A plug connector comprising:

a plug formed with an insulating body having a sleeve portion with a receptacle compartment receiving a flat-ribbon cable, and an elongated portion extending away form the sleeve portion, communicating with said compartment through openings at a bottom thereof through which conductors of said cable pass and provided with at least one window assigned to each of said conductors and through which the respective conductors are exposed; and a coupler having an insulated hollow body receiving said plug in a force-free first position, said plug being swingable in said body of said coupler into an end position, said coupler having a respective contact assigned to each of said conductors and engageable through the respective windows with the respective conductors upon swinging of said plug from said one position into said end position, and detent means for retaining said plug in said end position.

13. The plug connector defined in claim 12 wherein said elongated portion is formed with a wall supporting each conductor opposite the respective window.

14. The plug connector defined in claim 12 wherein said sleeve portion is provided with a hook constructed and arranged to project into an opening between conductors of said cable upon insertion of said cable into said sleeve portion.

15. The plug connector defined in claim 12 wherein said elongated portion of said plug is formed with a respective window on diametrically opposite sides of each of said conductors and said coupler is formed with respective contact engageable through the windows disposed diametrically on opposite sides of each conductor for engagement with each conductor from opposite sides.

16. The plug connector defined in claim 15 wherein said windows have widths less than diameters of said conductors.

17. The plug connector defined in claim 16 wherein said windows are staggered axially along each of said conductors.

* * * * *